United States Patent [19]

Brown et al.

[11] 4,043,130

[45] Aug. 23, 1977

[54] TURBINE GENERATOR CYCLE FOR PROVISION OF HEAT TO AN EXTERNAL HEAT LOAD

[75] Inventors: Robert O. Brown; Albert E. Becker, both of Media, Pa.

[73] Assignee: Westinghouse Electric Corporation, Pittsburgh, Pa.

[21] Appl. No.: 699,771

[22] Filed: June 25, 1976

Related U.S. Application Data

[63] Continuation of Ser. No. 548,710, Feb. 10, 1975, abandoned.

[51] Int. Cl.[2] ..... F01K 23/02; F01K 3/00

[52] U.S. Cl. ..... 60/655; 60/652; 60/659; 60/678

[58] Field of Search ..... 60/648, 652, 655, 659, 60/677, 678

[56] References Cited

U.S. PATENT DOCUMENTS 3,886,749 6/1975 Pacault ..... 60/652

*Primary Examiner*—Allen M. Ostrager
*Attorney, Agent, or Firm*—F. J. Baehr, Jr.

[57] ABSTRACT

A steam turbine power plant having associated therewith a closed loop flow arrangement for extracting heat from the power plant and supplying the extracted heat to an external heat load. Included within the flow arrangement is a predetermined number of heater elements, each of which extracts steam having a predetermined heating capacity associated therewith from a predetermined number of separate locations within the power plant. The heat so extracted is transferred to a heat transfer medium flowing at a predetermined flow rate within the closed loop arrangement. The extracted heat is exchanged to the heat load within a heat exchanger element connected within the flow arrangement. The amount of heat extracted from the power plant is functionally related to, and automatically limited by, the flow rate of the heat transfer medium within the closed loop arrangement. The flow rate of the heat transfer medium is itself functionally related to the flow rate of the motive fluid for the power plant.

8 Claims, 1 Drawing Figure

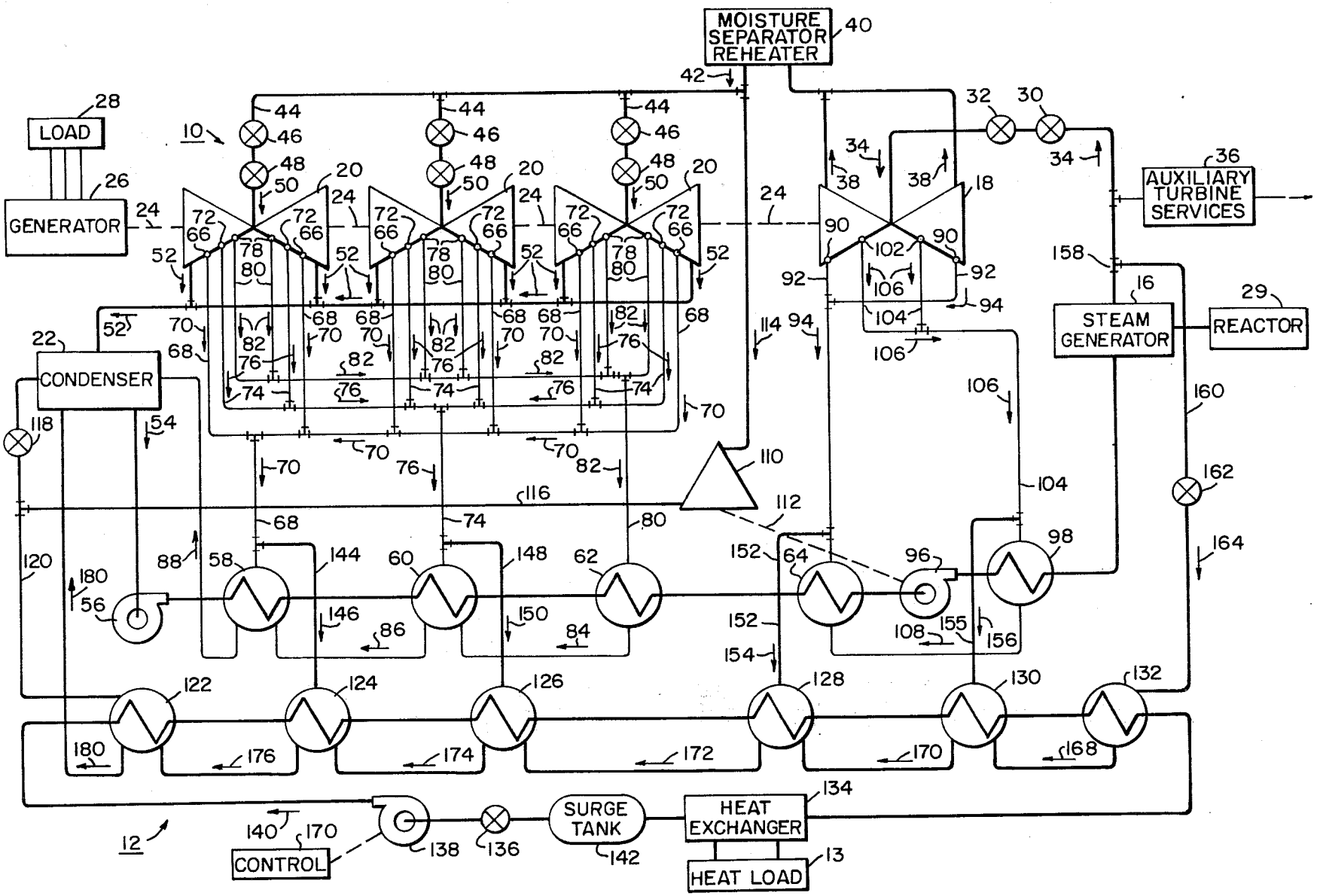
AUXILIARY TURBINE SERVICES
REACTOR
STEAM GENERATOR
MOISTURE SEPARATOR REHEATER
HEAT EXCHANGER
HEAT LOAD
SURGE TANK
CONTROL
LOAD
GENERATOR
CONDENSER

TURBINE GENERATOR CYCLE FOR PROVISION OF HEAT TO AN EXTERNAL HEAT LOAD

This is a continuation of application Ser. No. 548,710 filed Feb. 10, 1975 now abandoned.

BACKGROUND OF THE INVENTION

1. Field of the Invention

This invention relates to steam turbine power plants, and, in particular, to a steam turbine power plant having associated therewith an associated closed loop flow arrangement for extracting heat from the power plant and supplying the heat so extracted to an external heat load.

2. Description of the Prior Art

Recently, emphasis has been placed on the realization of an economically attractive "dual-purpose" power generation facility adapted to fulfill a two-pronged goal of simultaneous electric power generation and brine desalinization. In such dual purpose facilities, it has been anticipated that the motive fluid for the electric power generation be supplied by a nuclear powered steam generator, while the desalinization of brine is effectuated by the application of the "flash evaporation" process.

Briefly, flash evaporation is a multi-stage distillation process in which sea water is progressively heated to a predetermined temperature under given pressure conditions and then introduced into a chamber maintained at a lower pressure just below the boiling point of the heated brine. As the heated brine enters the lower pressure chamber, the reduced pressure therein causes the brine solution to boil, or "flash", into steam. The steam so produced is condensed and the fresh water produced thereby is conducted away. It has been anticipated that the heat necessary to raise the temperature level of the brine be extracted from the nuclear-fuel steam turbine power plant.

In the prior art, it is common practice to raise the temperature of the brine solution by conducting steam from one predetermined extraction location within the power plant directly to the brine heat exchanger. The heat of the extracted steam is there transferred to the brine. The condensate is returned to the steam cycle.

Although direct steam extraction techniques have been successful on small scale (50 megawatt or less) power stations, they have little applicability for large capacity water desalinization power plants. Also, extraction of volumes of steam larger than a predetermined amount from only one location within the power plant may deleteriously affect the power generation cycle and require extensive modifications from current design and operating experience. In sum, direct steam extraction as the heat source for flash evaporation desalinization is of limited usefulness.

To provide heat necessary for larger scale water-making capabilities, it has been proposed to utilize a "bobtailed" turbine apparatus of a relatively large size, on the order of 1200 M.W. In such a scheme, the exhaust of the steam cycle is directly introduced as the heat source for the brine heater. The heat of condensation of the exhausted steam raises the temperature of the brine solution, while the condensate returns to the steam generator element of the power plant.

The main disadvantage of such an arrangement arises from the substitution of the brine heater for the standard condenser element. Such a substitution raises the back pressure — the pressure immediately downstream of the last array of rotating blades — so that there is little or no power generation from this blade array. It is apparent that such a condition would adversely affect the output and reliability of the electrical generating plant.

In order to obviate these difficulties due to the increased back pressure, it has been suggested that the rotating blades in the last array be shortened, or "bobtailed", to a height less than the blade height for a normal last row blade of commensurate power capability. This tailoring of blade heights to meet system requirements and the resulting higher power density requires specially designed blades for each individual application. This, of course, precludes the use of proven and reliable standardized components. The probability of failure increases commensurately, and the efficiency and capability of the electrical plant is permanently impaired.

In addition, such plants may not be downed for repair without simultaneously halting desalinization procedures. Conversely, as long as the production of fresh water is required, the steam plant must be operated. Still further, by providing specially tailored blades, there may be generated severe control problems, especially in the overspeed control, due to the loss of rotational inertia.

It is apparent that there is required a steam power generation system having associated therewith an efficient heat cycle for large capability water desalinization able to deliver the maximum heat transfer yet still utilizing standardized proven components. It is also patent that a system and heat cycle utilizing heat extracted from a multiplicity of sources within the power plant to supply the heat load is a definite improvement over prior art systems. In addition, a heat cycle adaptable to divert steam to provide higher or lower water capability depending upon peak electricity demand, and to provide water desalinization during periods of turbine inactivity, is also advantageous over the present art.

SUMMARY OF THE INVENTION

The steam turbine power plant embodying the teachings of this invention provides heat to an external heat load and overcomes the disadvantages mentioned in the prior art in a novel, useful, and unobvious manner.

The steam turbine power plant comprises, in series, a steam generator element, a high pressure element, a low pressure turbine element, and a condenser element. A closed loop flow arrangement, which confines and guides a heat transfer medium therein, is cooperatively associated with the power plant to extract heat therefrom and supply the heat so extracted to the heat load. The flow arrangement includes at least two heater elements connected to a heat exchange element and to a flow control device. The heater extracts heat, in the form of steam, from at least two different extraction locations, each having a different heating capacity associated therewith, within the power plant. Provision may be made for a predetermined number of different extraction locations or other heat sources from the power generation cycle. The heat thus extracted is transported by the heat transfer medium to the heat exchange element, where it is exchanged with the heat load. The amount of heat extracted from the power plant is functionally related to the flow rate of the heat transfer medium. The flow rate of the heat transfer medium is controlled by the flow control device.

In order to provide capability for heat transfer during off-peak hours of the power plant, one heat source location provides a bypass from the steam generator to a heater element. In the event of increased electric demand, the bypass may be closed.

It is an object of this invention to provide a steam turbine power plant having an associated heat transfer cycle able to extract the greatest amount of heat while using standardized power plant elements and not requiring specialized component design.

It is a further object of this invention tc efficiently transfer heat to an associated heat load from a plurality of heat sources within the power plant, thus not overtaxing any one single extraction zone. It is yet a further object to provide a closed loop heat flow arrangement associated with a steam turbine power plant in which the amount of heat extracted from the power plant is directly controlled by the flow rate of the heat transfer medium flowing within the flow arrangement. It is a still further object of the invention to provide a heat flow arrangement associated with a steam turbine power plant adapted so that the requirements of an electrical load, heat load or both, may be met, depending upon the relative demand placed on each, in an easily regulable manner. It is another object of the invention to provide a flow arrangement associated with a steam power plant that is operable even during nonproductive periods of the power plant. Other objects of the invention will become clear in the following detailed description of the preferred embodiment.

BRIEF DESCRIPTION OF THE DRAWING

The invention will be more fully understood from the following detailed description, taken in connection with the accompanying drawing, in which:

The FIGURE is a schematic representation of a steam turbine power plant having a heat transfer arrangement associated therewith which embodies the teachings of the invention.

DESCRIPTION OF THE PREFERRED EMBODIMENTS

Referring to the FIGURE, reference number 10 refers to a steam turbine power plant having associated therewith a separate closed-loop heat transfer cycle 12 adapted to extract heat from the power plant 10 and apply the heat so extracted to a separate heat load 13. The power plant 10 is a standard steam power generation facility comprising, in series connection, a steam flow passing from a steam generator element 16, a high pressure turbine element 18, low pressure turbine elements 20, and a condenser 22. Each of the turbine elements are mechanically linked on a common shaft 24 and connected to an electrical generator element 26. The turbines convert high temperature and high pressure energy of the motive steam to rotational energy of the shaft 24, which is in turn converted, by the generator 26, to electrical energy for a related electrical load 28.

In plants such as this, the steam generator element 16 normally converts feed water to steam by applying thereto heat taken from a nuclear fuel reactor element 29. However, it is to be understood that although the plant 10 to be described herein is a nuclear power plant, the teachings of this invention apply equally well for both nuclear and fossil fuel applications.

High pressure, high temperature motive steam is conducted from the steam generator element 16, through a series of stop valves indicated at numeral 30 and an array of flow control valves indicated at 32, and into the inlet of the high pressure turbine 18, this steam flow being illustrated by reference arrows 34. Although the high pressure turbine element 18 is illustrated as being a double flow apparatus, it is of course, understood, that any suitable high pressure turbine element may be utilized. Similarly, although there is shown a bank of three, double-flow low pressure turbine elements 20, it is also to be understood that any suitable number of low pressure elements of any suitable type, depending upon the electrical power system parameters, may be used. The point worthy of note is that whatever the number and type of turbine elements chosen, the elements so chosen are standard units adapted to convert steam energy to rotational mechanical energy. There is required little alteration to any of the turbine elements chosen in order to practice the teachings of this invention and supply heat to the separate, closed-loop heat cycle 12.

There may be provided, upsteam of the stop valves 30, suitable high pressure taps, as at 36, to supply motive fluid for auxiliary steam system services, such as steam for the gland seals disposed about the shaft 24, and steam to the air ejectors located throughout the system but omitted here for clarity. After expanding through the high pressure turbine element 18, the steam is exhausted therefrom, as shown by the flow arrow 38 and is conducted into a combined moisture separator-reheater element (MS-R) 40 where the steam exhausted from the high pressure turbine is raised in temperature before exiting the MS-R 40, as shown at 42. Steam for the reheating function of the MS-R 40 is usually taken from a tap located upstream of the stop valve 30, but such a connection has been omitted from the FIGURE for clarity.

From the exit 42 of the MS-R 40 to the steam flow passes through parallel inlet conduits 44, each having disposed therein an array of stop valves 46 and interceptor valves 48, into the inlets of the low pressure turbine elements 20, the flow indicated by reference arrows 50. The steam expands through the low pressure turbine elements 20 and exhausts therefrom, as shown at arrows 52, into the condenser 22. Here the steam is returned to the liquid state in the form of condensate.

From the outlet of the condenser 22, the condensate is conducted, as shown by arrow 54, to a condensate pump 56. The condensate pump 56 pumps the condensate from the condenser 22 through a series of feedwater heaters 58, 60, 62 and 64. The feedwater heaters have as their function, the task of raising the temperature of the condensate passing therethrough to a higher temperature in anticipation of the reintroduction of the condensate to the steam generator 16. Heat for this task is supplied by extracting steam from preselected extraction zones within the turbines 18 and 20. As seen in the FIGURE, the heater 58 is supplied with extraction steam taken from a first predetermined extraction zone 66 within the low pressure turbines 20. The steam extracted from zone 66 is conducted through conduits 68 into the reheater 58 as illustrated by flow arrows 70. Similarly, steam is extracted from a second predetermined extraction zone 72 within the low pressure turbines 20, through conduits 74 and into the reheater 60, the flow being shown by reference arrows 76.

In like manner, steam is extracted from a third predetermined extraction zone 78 within the low pressure turbine 20 and conducted through conduits 80 into the third reheater 62, this flow being illustrated by reference arrows 82. As is apparent, each of the extraction zones 66, 72 and 78 extracts steam from within the turbine 20 at a higher temperature and pressure condition, and thus the steam so extracted has associated therewith an increasingly higher heat capacity. In order to fully utilize the heat content of the extracted steam, the drains of the reheaters 62, 60 and 58 are cascaded into each other, as illustrated by flow arrows 84 and 86. The drain from the reheater 58 is conducted, as shown by arrow 88, into the condenser 22. Some plants provide, intermediate between the condensate pump 56 and the first feedwater heater 58, a condenser which returns gland sealing steam to the liquid state. The drain from the gland condenser, although omitted for clarity, enters into the main condenser at a point intermediate between the drain of the feedwater heater 58 and the condenser 22.

As seen from the FIGURE, the heater 64 derives its heat from steam extracted from a predetermined extraction zone 90 within the high pressure turbine 18, through conduits 92, the flow being illustrated by flow arrows 94.

A boiler feed pump 96 is located downstream of the heater 64 and pumps the now-heated condensate through a final feedwater heater 98. From the final feedwater heater 98, the condensate, now known as boiler feedwater, is conducted to the steam generator 16 to complete the steam power plant loop 10, the flow being illustrated by reference arrow 100. The final feedwater heater 98 utilizes steam extracted from a second predetermined extraction zone 102 located within the high pressure turbine 18, the steam being conducted through conduits 104, as shown by flow arrows 106. As seen from the FIGURE, the second predetermined extraction zone 102 occurs at a location within the high pressure turbine 18 that has associated with it a greater heat capacity than does the steam from extraction zone 90. In order to efficiently extract all available energy from the higher heat capacity steam, the drain of the final feedwater heater 98 is cascaded, as shown by arrow 108, into the heater 64. The drain from the heater 64 is itself pumped by a drain pump (not shown) into the condensate flow to a point (not shown) immediately upstream of the boiler feed pump 96. For completeness, the drain from the moisture separator portion of the MS-R 40 also is collected and pumped by the drain pump (not shown) to the point (not shown) immediately upstream of the boiler feed pump 96. Also omitted from the FIGURE for clarity is the connection between the drain of the reheater portion of the MS-R 40 and the final feedwater heater 98.

In order to provide motive power for the boiler feed pump 96, there is provided a boiler feed pump drive turbine 110, which is linked mechanically by a shaft 112 to the boiler feed pump 96. The motive fluid for the drive turbine 110 is often provided by a tap immediately downstream of the MS-R 40, the flow being illustrated by arrow 114. It should be understood that similar drive turbines or other mechanical linkages are disposed to provide motive energy for other apparatus associated with the power plant 10, of which the feed pump 96 is illustrative. For example, power must be provided to the condensate pump 56 and air ejectors. Although such linkages are omitted for clarity, it is to be understood that there exist drive turbines or drive motors, such as that shown at 110, to provide power to these associated apparatus. The exhaust from the drive turbine 110 is conducted, in a normal power plant, through conduit 116 to the condenser 22. However, in accordance with this invention, a control valve 118, normally closed, is provided between the conduit 116 and condenser 22. In a manner which is more fully explained herein, the exhaust from the drive turbine 110, or other power sources for the steam systems associated apparatus, is conducted by conduit 120 into, and acts as a one of the heat sources for, the separate heat cycle 12 taught by this invention.

It is also known in the art that the control of the flow of condensate in that portion of the power plant 10 between the condensate pump 56 and the boiler feed pump 96 is managed by a suitable control arrangement (not shown). It is to be understood, however, that there is a predetermined flow rate associated with the condensate flow within the plant 10.

Cooperatively associated with the power plant 10 is the heat transfer cycle 12. As stated earlier, the steam power plant 10 is a standard power generation facility. All elements contained therein are sized and designed such that high efficiency and maximum electrical generating capability is maintained. The heat transfer cycle 12 is a closed loop arrangement cooperatively associated with the steam plant 10 to extract heat therefrom and supply the heat so extracted to the external heat load 13. Although this application will discuss the heat load in terms of brine heating for a water desalinization plant to provide fresh water, it is to be understood that any heat load, such as industrial or residential heating, may be supplied.

The heat cycle 12 typically comprises heater elements 122, 124, 126, 128, 130 and 132 disposed so as to extract heat from the power plant 10 and transfer that heat to a heat transfer medium, such as, but not limited to, water under a predetermined pressure, flowing within the closed loop flow arrangement 12. The extracted heat carried by the heat transfer medium is exchanged in a heat exchanger element 134, in this instance a brine heater, and supplied to the heat load 13. Completing the closed loop arrangement 12 is a flow control valve 136 and a variable speed pump 138, similar to the condensate pump 56, to control the flow rate of the heat transfer medium, the flow direction being indicated by arrow 140. If necessary, a surge tank 142 may be added to the arrangement.

The heat transferred by the heaters to the heat transfer medium is obtained by extraction of steam from predetermined locations within the power plant 10. The steam extraction locations for each particular heater will be discussed in turn.

The heater 122 obtains steam exhausted from the drive turbine 110 powering the associated steam apparatus, such as the boiler feed pump 96, through conduits 116 and 120. The pressure of the steam so extracted, typically, approximates that of the lowest pressure feedwater heater 58. In the case of no water demand, of course, the valve 118 is opened, to permit exhaust directly to the condenser 22.

As seen from the FIGURE, heaters 124 and 126 extract heat from the plant 10 through the extraction of steam from predetermined locations within the low pressure turbines 20. For example, heaters 124 is supplied by a conduit 144 tapping into the conduit 68 and extracting steam from steam extraction zone 66, this flow being illustrated by arrow 146. Heater 126, in similar manner, is connected through a conduit 148 which taps into the conduit 74 to extract steam from the extraction zone 72 within the low pressure turbine 20, this flow illustrated by arrow 150.

Heaters 128 and 130 are, as shown, supplied with extraction steam from extraction zones 90 and 102 respectively, within the high pressure turbine 18. In the case of the heater 128, a conduit 152 taps into the conduit 92 to extract steam from zone 90, the exhaust of the high pressure turbine 18, that flow being illustrated by arrow 154. For the heater 130, the conduit 104 from zone 102 is tapped by conduit 155, the flow being illustrated by arrow 156.

The steam source for the heater 132 is a tap 158 immediately past the outlet of the steam generator 16, a bypass conduit 160 having a normally closed control valve 162 disposed therein regulating the flow, as illustrated by flow arrow 164. As will be discussed herein, the provision of the bypass conduit 160 enables the heat cycle 12 associated with the power plant 10 to be operable even during periods of zero electrical power generation, during periods of low electrical loads or during periods of peak water demand.

Normally, however, the control valve 162 is closed, but extraction of steam from the other sources, as outlined, provides the sufficient heat necessary to produce desalinization. It is apparent from examination of the FIGURE that the cycle 12 extracts steam from several distinct locations within the plant 10, each of which has associated therewith a separate heating capacity. By heating capacity it is meant the heat content, or enthalpy, associated with the steam at the particular temperature and pressure at which that steam is taken from the plant 10. For example, it is clear that steam extracted to the heater 130 from the extraction zone 102 within the high pressure turbine 18 has a greater heating capacity than steam extracted to the heater 124 from the extraction zone 66 within the low pressure turbine 20. By providing a closed loop 12 able to take heat from a predetermined plurality of locations within the power plant 10, sufficient heat may be provided for a large-scale desalinization project without overly taxing any single heat source location. Provision of the closed loop 12 enables maximum heat transfer to occur from the steam cycle 10 to the heat transfer cycle 12 while still permitting utilization of standard components within the steam plant.

Of course, in order to enhance the efficiency of the cycle 12, the drain from each higher pressure heater is cascaded into the next lower pressure heater, as illustrated by arrows 168, 170, 172, 174 and 176. The drains of the lowest pressure heater 122 in the heat cycle 12 is returned, as shown by the flow arrow 180, to the condenser 22.

The flow rate of the heat transfer medium within the closed loop heat transfer cycle 12 is controlled, as stated, by the pump 138 in association with the valve 136. The flow rate is related to the rate of main condensate flow between the pumps 56 and 96 which is part of the overall motive fluid flow rate of the power plant 18. The heat transfer medium flow rate is between 0 to 0.8 of the main condensate flow rate, the exact value of heat transfer medium flow rate being determined by a suitable control arrangement 170 associated with the overall power plant control (not shown) and being functionally related to the demand required by the desalinizer.

In operation, then, for a given heat demand, the heat transfer medium passes within the closed-loop cycle 12 at a predetermined flow rate between 0 and 0.8 of the main condensate flow rate. The heat transfer medium is heated by passage through the heater 122 supplied from the exhaust of the drive turbine 110, through the heaters 124 and 126 supplied with heat by extraction from the low pressure turbine 20; and through the heaters 128 and 130 supplied by steam extracted from the high pressure turbine 18. If necessary, the medium is further heated by the heater 132 supplied with steam through the bypass conduit 160 from the steam generator 16. The heat so extracted is transferred from the heat transfer medium to the brine within the heat exchanger 134. The steam extracted from the plant 10 is returned to the condenser 22, after cascading through the lower pressure heaters.

As may be appreciated by one skilled in the art, the volume of the steam extracted from the power plant 10, and thus the magnitude of heat extracted therefrom, is directly related to the flow rate of the heat transfer medium. For example, attention is directed to the heater 126, supplied with steam extracted from the extraction zones 72 within the low pressure turbines 20. The steam so extracted has associated therewith a predetermined pressure, for example approximately 25 p.s.i.a. and an associated temperature, here, 240° F. When such steam is conducted into the shell of the reheater 126, it condenses on the tubes passing therethrough and having the heat transfer medium therein. The heat transfer medium takes the heat of vaporization from the extracted steam at the given pressure, and temperature, here 240° F, and the heat-transfer medium is heated thereby. As the heat of vaporization is taken by the heat transfer medium, the extracted steam condenses, and more steam is drawn into the heater from the extraction zone. However, it is apparent that the temperature of the heat transfer medium may only rise to the saturation temperature associated with the pressure of the extracted steam, in this instance, to 240° F. Once the heat transfer medium is heated by the extraction steam to this temperature, that medium takes no additional heat from the extracted steam. With this occurrence, no further extracted steam condenses in the heater 126, and no further steam is extracted from the zone 72 to the heater 126. Thus, the volume of steam extracted is automatically limited by a thermodynamic equilibrium established within the heater 126. This process is similar to that occurring in all the heaters within the closed loop heat transfer cycle 12, no matter what the location of the heat source supplying the heater.

To further increase the volume of steam extracted, it is simply necessary to increase the flow rate of the heat transfer medium. Since more of the medium will pass through the heater 126, more medium will be available to take the heat of condensation from the extracted steam. Therefore, more of the extracted steam condenses within the heater 126, and therefore more steam is extracted from the turbine 20. Conversely, of course, to decrease the amount of steam extracted from the plant 10, the simple expedient of lowering the flow rate of the heat transfer medium accomplishes this result. In the extreme case, i.e., when the water demand is zero, no steam will be extracted if the heat transfer medium flow is stopped. As stated, then, by varying the flow-rate of the heat transfer medium between 0 and 0.8 of the predetermined flow rate of the main condensate flow, the volume of steam extracted from the power plant is directly controllable. Of course, any known expedient for controlling the flow rate of the heat transfer medium is within the contemplation of this invention. The flow rate of the heat transfer medium is controlled so as to maintain steam extraction from the various heat source locations within allowable design capabilities of a power generation cycle utilizing standard turbine elements.

If the electrical load condition on the power plant 10 were to be reduced by a given amount, the flow rate of the motive fluid through the power generation cycle, which includes the condensate flow, is commensurately reduced. If the flow rate of the heat transfer medium was not correspondingly adjusted, the heaters within the heat transfer cycle 12 would extract, from the heat source locations within the power plant 10, volumetric flows of steam greater than those optimumly permitted by standard system components. Therefore, it is appreciated that the flow rate of the heat transfer medium is functionally related to the flow rate of the main condensate flow, with the heat transfer flow rate being at all times within the limits 0 to 0.8 of the main condensate flow rate.

During periods of low electrical loads, then, the motive fluid flow requirements of the power generation cycle 10 are lower, necessarily resulting in a lower heat transfer medium flow rate. If, however, at this same time there is imposed upon the heat transfer cycle 12 an increase in the heat load, this increase may be met by simply opening the control valve 162 to initiate flow from the steam generator 16 to the heater 132.

It is appreciated then that the closed loop heat transfer cycle 12 associated with the power plant 10 admirably accomplishes all those functions unable to be effected by prior art systems. There is provided an overall system for the supply of heat to a desalinization plant, or other heat load, which utilizes proven, standardized turbine-generator component designs. By provision of the closed-loop cycle, heat is extracted from a predetermined plurality of locations within the power plant, thus no one location is overtaxed for extraction steam, thus guaranteeing maximum heat transfer capability while maintaining the capability for generation of large amounts of electrical power with standard components. There is also provided full capability for power during peak electrical periods. By closing the valve 162 in the bypass conduit 160, and reducing the heat transfer medium flow rate to zero, full rated electrical power may be generated.

Provision is also made for the production simultaneously of both electricity and water, during periods of moderate electrical and moderate water demand. Perturbations in water demand may be accommodated, for example, by varying the heat-transfer flow rate, by opening the control valve 162, or by using the valve 162 to modulate an already established bypass flow. The ratio of electrical output to heat output may thus be varied on command. A switch-back capability between electricity and water demands may also be easily accommodated.

The system embodying the teachings of this invention also provides for water production during periods of no electrical demand, or during periods of turbine unavailability. By providing the closed loop cycle, the heat demand is no longer tied to the actual operation of the power generating facility. Conversely, needed turbine maintenance or inspection need not be dependent upon periods of slack water demand. Implicit to this consideration is the ability to provide water during off-peak electrical periods while still maintaining peak electrical capability on demand.

It being understood that although a specific preferred embodiment of the invention has been shown and described, modifications may be made without departing from the spirit of the invention, as embodied in the appended claims.

We claim:

1. A steam turbine power plant comprising, in series, a steam generator element, a high pressure turbine element, a low pressure turbine element, a condenser element, a high pressure feedwater heater extracting steam from a predetermined location within said high pressure turbine element, a low pressure feedwater heater extracting steam from a predetermined location within said low pressure turbine element, said steam extracted from said high pressure turbine having associated therewith a heating capacity different from the heating capacity of said steam extracted from said low pressure turbine element, a closed loop flow arrangement disposed only in heat transfer relationship with said power plant to extract heat therefrom to supply a heat load, said flow arrangement confining and guiding a heat transfer medium therewithin, a first and a second heater element connected within said flow arrangement, said first heater element extracting heat from said power plant by extracting steam from said predetermined location within said low pressure turbine element and disposed in parallel with said low pressure feedwater heater, said second heater element extracting heat from said power plant by extracting steam from said predetermined location within said high pressure turbine element and disposed in parallel with said high pressure feedwater heater, said heater elements transferring said extracted heat to said heat transfer medium, a heat exchange element connected within said flow arrangement for exchanging said extracted heat in said heat transfer medium to said heat load, and, means for controlling the rate of flow of said heat transfer medium within said closed loop flow arrangement, the magnitude of said heat extracted from said power plant being directly controlled by said flow rate of said heat transfer medium.

2. The power plant of claim 1, further comprising:

a third heater element connected within said flow arrangement, said third heater element extracting heat from a third location within said power plant and transferring said extracted heat to said heat transfer medium, said third location being disposed away from said first and second locations and having a heating capacity associated therewith different from said heating capacities associated with said first and second locations, the magnitude of said heat extracted from said third location within said power plant being directly controlled by said flow rate of said heat transfer medium within said closed loop flow arrangement.

3. The power plant of claim 2 wherein said third location is disposed intermediate between said steam generator element and said high pressure turbine element.

4. The power plant of claim 3, further comprising:

flow interruption means for interrupting steam flow disposed between said third heater element and said extraction point intermediate said steam generator element and said high pressure turbine element.

5. The power plant of claim 3, further comprising an associated apparatus connected in series within said power plant, said associated apparatus being driven by a drive turbine element operatively connected within said power plant, a fourth heater element connected within said flow arrangement at a point upstream of said first heater element, said fourth heater element extracting heat from said power plant and transferring said extracted heat to said heat transfer medium, said fourth heater element extracting heat from said power plant by extracting steam from said drive turbine element, the heating capacity associated with said steam extracted from said drive turbine element being different from the heating capacity associated with said steam extracted by said first, second, and third heater elements, the amount of said steam extracted from said drive turbine element being directly controlled by said flow rate of said heat transfer medium within said closed loop flow arrangement.

6. The power plant of claim 5, further comprising:

a fifth heater element connected within said flow arrangement at a point intermediate said first and said second heater elements, said fifth heater element extracting heat from said power plant and transferring said extracted heat to said heat transfer medium, said fifth heater element extracting heat from said power plant by extracting steam from a second extraction point within said low pressure turbine element, the heating capacity of said steam extracted from said second extraction point within said low pressure turbine element being greater than the heating capacity of said steam extracted from said first extraction point within said low pressure turbine element, the amount of said steam extracted from said second extraction point within said low pressure turbine element being directly controlled by said flow rate of said heat transfer medium within said closed loop flow arrangement.

7. The power plant of claim 6, further comprising:

a sixth heater element connected within said flow arrangement at a point intermediate said second and said third heater elements, said sixth heater element extracting heat from said power plant and transferring said extracted heat to said heat transfer medium, said sixth heater element extracting heat from said power plant by extracting steam from a second extraction point within said high pressure turbine element, the heating capacity of said steam extracted from said second extraction point within said high pressure turbine element being greater than the heating capacity of said steam extracted from said first extraction point within said high pressure turbine element, the amount of said steam extracted from said second extraction point within said high pressure turbine element being directly controlled by said flow rate of said heat transfer medium within said closed loop flow arrangement.

8. The power plant of claim 2, wherein said steam produced by said steam generator element is condensed by said condenser element and is returned in liquid form to said steam generator element, the flow of said liquid from said condenser element to said steam generator element having a predetermined flow rate associated therewith, and, said means for controlling the rate of flow of said heat transfer medium being functionally related to and variable in a range of values between 0 and 0.8 of said predetermined flow rate of said liquid.

* * * * *